155-1 SR
10/22/85 4,548,257

United States Patent [19]

Williamson

[11] Patent Number: 4,548,257

[45] Date of Patent: Oct. 22, 1985

[54] BAYONET TUBE HEAT EXCHANGER

[76] Inventor: William R. Williamson, 8310 Pilgrim Rd., Pensacola, Fla. 32504

[21] Appl. No.: 617,760

[22] Filed: Jun. 6, 1984

Related U.S. Application Data

[63] Continuation of Ser. No. 350,804, Feb. 22, 1982, abandoned.

[51] Int. Cl.[4] ..... F28B 9/10; F28B 9/08

[52] U.S. Cl. ..... 165/1; 165/113; 165/142; 165/158

[58] Field of Search ..... 165/113, 142, 158, 1; 29/726

[56] References Cited

U.S. PATENT DOCUMENTS

| | | | |
|---|---|---|---|
| 1,574,675 | 2/1926 | McKean et al. | 165/142 |
| 2,243,593 | 5/1941 | Zallea | 165/142 |
| 2,549,687 | 4/1951 | Jack et al. | 165/156 |
| 3,059,396 | 10/1962 | Thees | 165/113 |
| 3,181,606 | 5/1965 | Belanger | 165/158 |
| 3,533,267 | 10/1970 | Bunnell | 72/299 |
| 3,681,936 | 8/1972 | Park | 165/156 |
| 4,142,580 | 3/1979 | Bailey | 165/142 |

FOREIGN PATENT DOCUMENTS

| | | | |
|---|---|---|---|
| 122563 | 1/1919 | United Kingdom | 165/135 |

*Primary Examiner*—Sheldon J. Richter
*Attorney, Agent, or Firm*—George A. Bode

[57] ABSTRACT

A bayonet tube heat exchanger and the method of use of the exchanger, the exchanger having a bayonet tube positioned within a sheath, the bayonet tube is used to create an annulus with the sheath for condensing vapors inside the sheath and to remove condensate and non-condensible gases under vacuum through the bayonet tube. An alternate embodiment uses an insulated plastic bayonet tube positioned within a sheath, the plastic bayonet tube used as an inlet for fluids into a small annular passage between the bayonet tube and its sheath with high turbulence for heat transfer in condensing vapors outside the sheath. Multiple sheaths and bayonet tubes are disclosed for applications to vapor recompression and long tube flash evaporators and to freon chillers and condensers.

31 Claims, 10 Drawing Figures

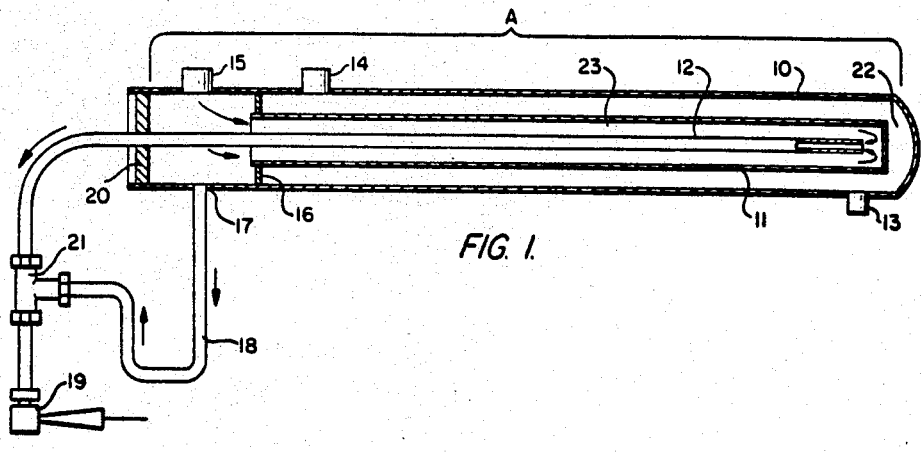
FIG. 1.
FIG. 2.
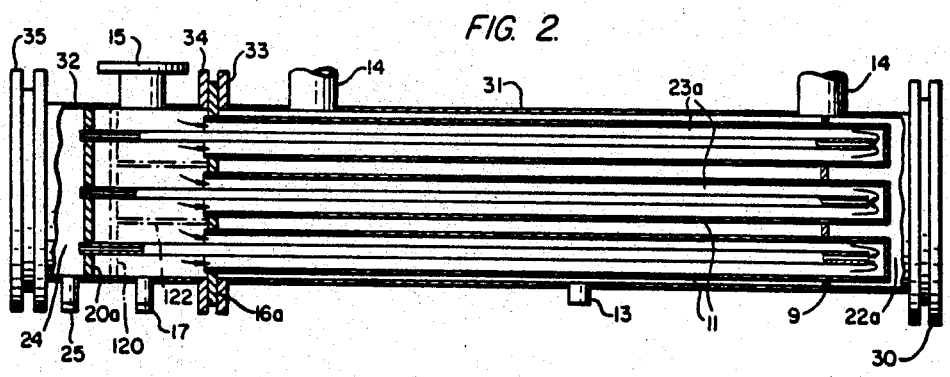
FIG. 3.
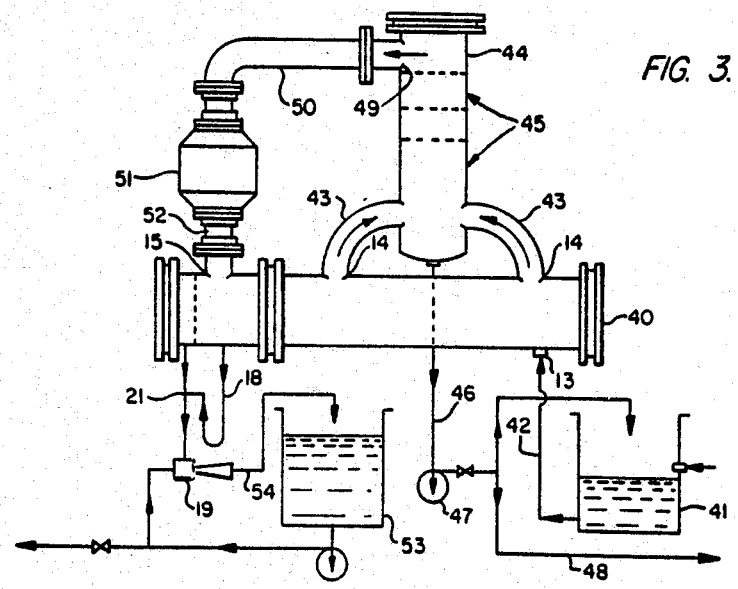

FIG. 4.
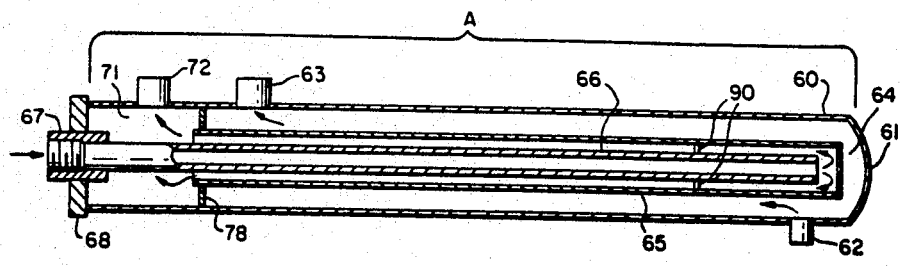
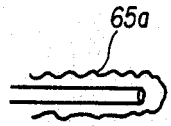
FIG. 4A
FIG. 5.
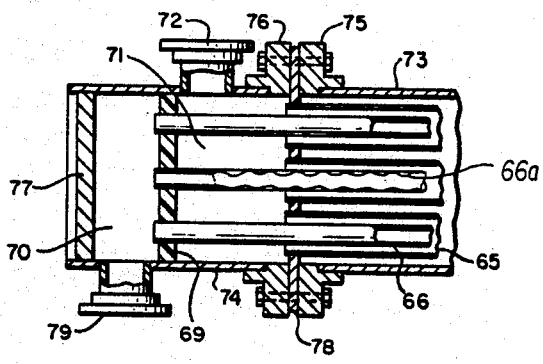
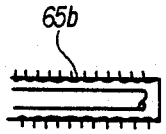
FIG. 4B
FIG. 6.
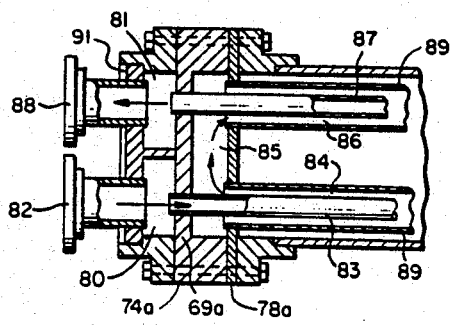

BAYONET TUBE HEAT EXCHANGER

BACKGROUND OF THE INVENTION

1. Field of the Invention

This application is a continuation of a previous application by the same inventor bearing Ser. No. 350,804, filed Feb. 22, 1982 and now abandoned.

The present invention relates to the structure of a bayonet tube heat exchanger and the method of use of such structure.

2. Description of the Prior Art

The structure of the so-called bayonet tube heat exchanger has been found to have many uses in addition to merely exchanging heat between two fluids having a heat differential. For example, the structure of the bayonet tube heat exchanger has been found useful in the condensing of fluid, purifying of liquids, and recovery of valuable chemicals from a fluid.

Some problems, however, have developed in the use of the conventional structure of the bayonet tube heat exchanger both in the traditional sense of pure heat exchange and in more sophisticated uses. For example, in the traditional exchange of heat, non-condensible gases entrained in one of the fluids involved tend to accummulate in the exchanger and to lower heat exchange efficiency.

Another problem is the tendency of the cooling fluid to be reheated in its progress through the exchanger, thus reducing the efficiency of the exchanger. It is foreseen that the bayonet tube heat exchanger will find many new uses if the problem of reheat can be satisfactorily resolved.

One attempt at the solution of the problem of reheating in the bayonet tube heat exchanger is disclosed in U.S. Pat. No. 3,861,461. In this structure a complex double wall construction is utilized which materially increases the cost of manufacture of the exchanger.

SUMMARY OF THE INVENTION

It is, therefore, a principal object of this invention to improve the efficiency of the structure of bayonet tube heat exchangers.

It is another object of the invention to automatically remove non-condensible gases from a bayonet tube heat exchanger during a heat exchange operation.

It is a still further object of the invention to provide a structure for a bayonet tube heat exchanger which minimizes reheating of a fluid which is being cooled.

It is an ancillary object of the invention to improve the apparatus for guiding a plurality of bayonet tubes into multiple sheaths in forming or servicing bayonet tube heat exchangers.

In accordance with the invention, the bayonet tube heat exchanger has a substantially horizontal outer shell with an elongated center section and two end closures. The inner end has a first tube sheet closure and the distal end is closed. At least one thin gauge tubular sheath element is contained within the outer shell. Each sheath has a closed end adjacent the closed distal end of the shell and an open end facing the first tube sheet closure. The bayonet tube heat exchanger has means for forming a first fluid flow zone between the outer surface of the sheath and the shell and a bayonet tube concentrically positioned in each sheath. The bayonet tube pierce the first tube sheet closure, extend through the tube sheet and have an inner portion in the sheath terminating at an open end spaced from the closed end of the sheath.

There are also means provided for forming a second fluid flow zone between each bayonet tube and the inner surface of the associated sheath.

Preferably the means for forming the first fluid flow zone includes a second tube sheet closure joining the outer surfaces of the open ends of the sheaths and the inner surface of the outer shell and an inlet and outlet into the first fluid flow zone. The means for forming a second fluid flow zone preferably includes a plenum between the second tube sheet closure, the first tube sheet closure and the outer shell provided with at least one inlet and one outlet for this zone.

The bayonet tube heat exchanger of this invention in one preferred embodiment includes means for applying a vacuum source to the outer portions of the bayonet tubes, either directly to the end portions of the bayonet tubes or by use of a vacuum chamber adjacent the first tube sheet closure which is in fluid communication with a vacuum source and with the open ends of the bayonet tubes.

In accordance with one aspect of the invention, the means for forming a first fluid flow zone includes an inlet and an outlet through the shell and the means for forming the second fluid flow zone includes an inlet through each bayonet tube and an outlet through the shell.

Further in accordance with the invention, a method is provided for operating a bayonet tube heat exchanger by forming a first fluid flow zone between the outer shell and the tubular sheath, forming a second fluid flow zone between the inner surface of the sheath and the outer surface of a bayonet tube concentrically inserted into the sheath, flowing a first fluid through the first fluid flow zone, flowing a second fluid through the second fluid flow zone and applying a vacuum to the outer end of the bayonet tube for removing non-condensible gases entrained in the second fluid.

A bayonet tube heat exchanger having multiple tubes may be assembled by the use of a circular plate for positioning bayonet tubes in sheaths. The circular plate has a diameter substantially equal to the inner diameter of the shell and a plurality of holes corresponding in number of the number of sheaths and located in the plate in corresponding relationship to the sheaths. The holes in the positioning plate have a diameter slightly larger than the bayonet tubes and engageable for sliding the open end of the bayonet tubes through the holes and into the sheaths.

The present invention overcomes the problems of conventional bayonet tube heat exchangers which have low heat transfer efficiency and are of expensive construction. The present invention increases heat transfer rates and is a simple and relatively inexpensive construction. In one embodiment, by using an air lance or bayonet tube to remove non-condensible gases from vapor condensing in a sheath between the bayonet tube and an outer shell, it significantly increases the efficiency of heat exchange. In another embodiment, the invention increases heat transfer rates by using a plastic bayonet tube to prevent reheat of the cooling fluid. In this embodiment, the bayonet tube and sheath are sized to allow only a small annulus between the bayonet tube and the sheath which creates more turbulent fluid flow, thus providing higher heat transfer rates.

The invention described herein, as one of its applications, can be used in a distiller/concentrator system which is energy-efficient, reliable and which provides an effluent which can be recirculated. In addition, it may be used to recover high purity water for rinsing and valuable chemicals for reuse. Other applications include use of the bayonet tube heat exchanger in distillation systems, as a condenser, a flash evaporator or with a freon heat pump as the heat exchanger portion of the system.

BRIEF DESCRIPTION OF THE DRAWINGS

FIG. 1, is a side view, partially in section, of a single tube bayonet heat exchanger with an air lance in accordance with the invention;

FIG. 2 is a longitudinal cross-sectional view of a multiple tube embodiment of the bayonet tube heat exchanger of the invention, each tube having an air lance;

FIG. 3 is a schematic drawing of a vapor recompression evaporator in which the bayonet tube heat exchanger of either FIG. 1 or FIG. 2 can be utilized;

FIG. 4 is a longitudinal cross-sectional view of a single tube bayonet tube heat exchanger having a heavy walled plastic bayonet tube;

FIG. 4A is an enlarged sectional view of the distal end of the single bayonet tube heat exchanger of FIG. 4 having a spirally grooved sheath.

FIG. 4B is an enlarged sectional view of the distal end of the single bayonet tube heat exchanger of FIG. 4 having an externally finned and internally spirally grooved sheath.

FIG. 5 is an enlarged sectional view of the inner end of a multiple tube embodiment of the bayonet tube heat exchanger of FIG. 4 with a single pass arrangement;

FIG. 6 is an enlarged sectional view of the inner end of a multiple tube embodiment of the bayonet tube heat exchanger of FIG. 4 with a two pass water box arrangement;

DESCRIPTION OF PREFERRED EMBODIMENTS

Figure 7:
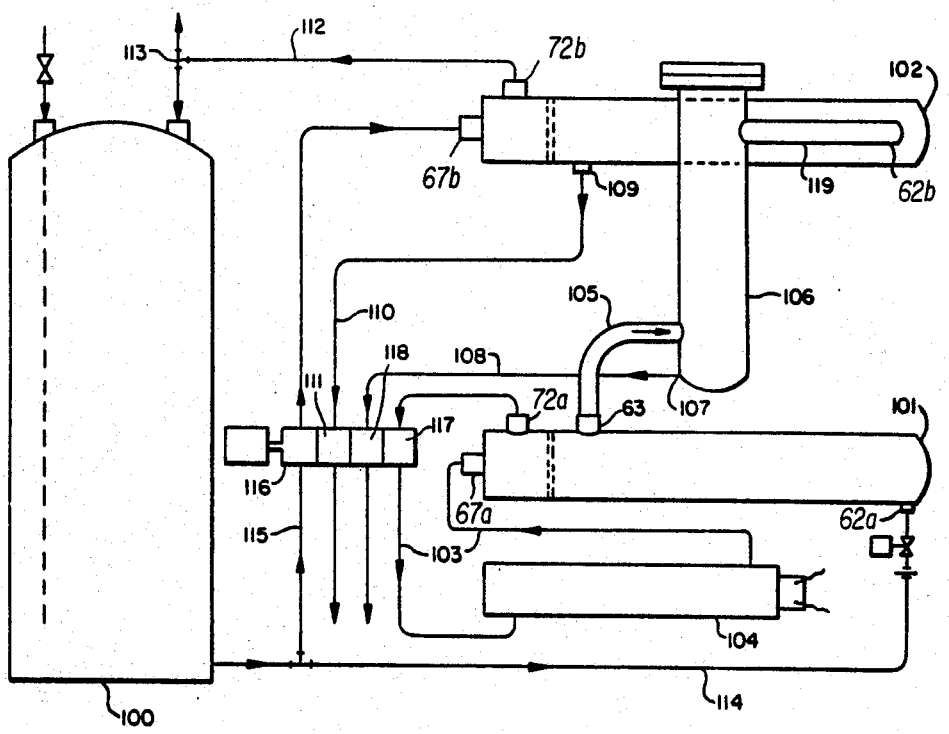
FIG. 7 is a general arrangement schematic of a domestic hot water system utilizing the bayonet tube heat exchanger of FIG. 4.

Reference will now be made in detail to the present preferred embodiments of the apparatus and methods of the invention, examples of which are illustrated in the accompanying drawings.

In accordance with the invention, the bayonet tube heat exchanger as shown in FIG. 1 includes an outer shell 10 with an elongated center section A, a tubular sheath 11 within the shell and a bayonet tube or air lance 12 within the sheath. Shell 10 is substantially horizontal and may be of tubular shape. The shell has a distal end closed by an end cap or, as shown in FIG. 1, by a permanently closed end portion and is sealed at its inner end by a first tube sheet closure 20.

The sheath 11 has a closed distal end adjacent, but spaced from, the closed distal end of the shell 10 and an open end facing the first tube sheet 20. Under the invention, means are provided for forming a first fluid flow zone within the shell surrounding the sheath. As embodied herein, such means include a second tube sheet 16 joining the outer surface of sheath 11 and the inner surface of shell 10 to form a fluid chamber 22 with an inlet 13 and an outlet 14 through the shell at substantially opposite ends and opposite sides of the center section A. The second tube sheet 16 forms a fluid-tight seal between sheath 11 and the shell 10 such that fluid entering chamber 22 through inlet 13 will flow around the sheath 11 and exit through outlet 14.

The bayonet tube 12 is positioned concentrically within the sheath 11. The tube 12 pierces the first tube sheet 20 and an inner portion of the bayonet tube extends substantially the entire length of the sheath 11, terminating in an open end spaced from the closed distal end of the sheath. The bayonet tube 12 has an outer portion which extends at least through the first tube sheet 20.

In accordance with the invention, means are provided for forming a second fluid flow zone within the sheath of FIG. 1. As embodied herein, such means include the second tube sheet 16, first tube sheet 20, a portion of the outer shell 10 between the first and second tube sheets and the area between the sheath 11 and the bayonet tube 12. This arrangement forms a fluid chamber 23 such that fluid entering inlet 15 through the portion of the shell 10 between the first and second tube sheets flows into the area between the bayonet tube and the sheath and, as described below, may exit either through an outlet 17 through the shell 10 or the bayonet tube 12, or through both.

When chamber 23, the second fluid flow zone, has a fluid, such as vapor or steam, introduced through inlet 15 and a first fluid, such as a cooling liquid circulating in the first fluid flow zone, i.e., chamber 22, the vapor in chamber 23 will condense on the interior walls of chamber 23, especially within sheath 11 where there is maximum opportunity for heat transfer from the steam to the circulating fluid in chamber 22. The condensed vapor collects within sheath 11 and would interfere with heat transfer if not removed.

In a preferred embodiment, the bayonet tube 12 of the heat exchanger is operated under a vacuum. Vacuum increases the infiltration of air into the heat exchanger system. Air, however, is a non-condensible gas under the operating conditions of these systems and tends to build up within sheath 11, creating a condition detrimental to transfer of heat through the walls of the sheath.

In order to make this system more efficient, the sheath tube 11 is inclined downward toward the second tube sheet 16. The condensate collecting within sheath 11 drains into the portion of chamber 23 adjacent drain outlet 17 from which the condensate exits the heat exchanger.

Additionally, the bayonet tube or air lance 12 is of considerably smaller diameter than the sheath 11 and is connected to a vacuum source such as eductor 19. The air lance of bayonet tube 12 under vacuum removes the non-condensible gases which tend to concentrate at the distal end of the sheath 11 and thus inhibit heat transfer. The air lance 12, in addition, provides a positive fluid flow drawing the steam, for example, into chamber 23 enabling higher flow rates of steam to be introduced into the exchanger. In single tube heat exchangers, as depicted in FIG. 1, the bayonet or air lance 12, after piercing the first tube sheet 20, may be connected directly to the eductor as shown.

Heat is transferred, for example, from high volume steam condensing within the sheath 11 to circulating water in chamber 22. A small diameter bayonet tube, less than one-quarter the diameter of the sheath, is used to remove the relatively small volume of non-condensible gases and entrapped condensate. The small surface area of the bayonet tube in relation to the sheath tube surface area, i.e., less than about one-sixteenth, minimizes reheat losses and more importantly, provides complete evacuation of the non-condensible gases in the condensing vapor.

The condensate draining into outlet 17 can be evacuated by a loop seal drain line 18 to a "T" connection 21 with the vacuum line to the bayonet tube 12, as shown in FIG. 1.

In order to provide for high heat transfer, relatively low cost and high corrosion resistance, the sheath 11 may be constructed of a thin gauge corrosion-resistant metal such as titanium or some known types of aluminum alloys. The second tube sheet 16 between the sheath 11 and the shell 10 can be made of the same material. When this device is used in the distillation of sea water or other corrosive media, use of corrosion-resistant metal is extremely important. The thin bayonet tube or air lance 12 can be constructed of plastic, copper or stainles steel since it contacts only pure steam or condensate and is not subject to the same corrosive environment as the exterior of the sheath.

The first tube sheet 20 for sealing the inner end of the shell 10 can be of plastic or carbon steel. If plastic is chosen, for the first tube sheet 20 or the bayonet tube 12, polyvinylchloride (PVC), fiberglass reinforced PVC or chloropolyvinylchloride (CPVC) are examples of suitable materials depending upon the operating temperature of the unit. Operational temperatures must be between approximately 30° F. and 180° F. for use of PVC and CPVC. The operating temperatures for a bayonet tube heat exchanger using metal bayonet tubes and sheaths can be considerably higher.

The bayonet tube heat exchanger of the embodiment of FIG. 1 of this invention is preferably operated under a vacuum, as stated above, and is designed to prevent formation of scale which would precipitate at atmospheric boiling temperatures. Likewise it can prevent the breakdown of heat sensitive chemicals by operating at lower than atmospheric boiling temperatures. In one application of this invention, a heat exchanger is operated under a vacuum to distill sea water. The sea water flows into chamber 22 and is heated by steam flowing in chamber 23. The steam has a velocity of 60–100 per second (ft/sec) as measured at the annulus area between 11 and 12. Using this volume of steam and operating under a vacuum of approximately 100 mm Hg absolute, the pressure differentials between chamber 22 and 23 may very small and an extremely light gauge titanium sheath can be used. In this application, it is also essential to remove the non-condensible gases because of their detrimental effect on heat transfer rates. This application has demonstrated heat transfer rates of over 650 BTU/ft$^3$/°F. with a delta T of only 10° F. compared to heat transfer rates of about 400 BTU/ft$^3$/°F. for standard shell-and-tube type heat exchangers.

FIG. 2 depicts a multiple tube arrangement of the bayonet tube heat exchanger of the type described in relation to FIG. 1. Common numerals have been used in FIG. 2 to designate corresponding elements in FIG. 1. The central section of the outer shell is preferably constructed of two parts 31 and 32. Each of these parts has a flange, respectively designated as 33 and 34, for providing mating surfaces which can be secured together to form a fluid tight seal as for example by bolts (not shown) about the circumference of the flanges. The distal end of the exchanger is preferably closed by an end head 30 which may contain a sight window for observation of the interior of the exchanger. The inner end of the exchanger is closed by another end head 35 which may be secured to part 32 of the shell by screw threads on the exterior end portion of the shell and on the interior surface of the head which mate to form fluid tight seals. A similar structure may be used for securing the end head 30 to the shell part 31.

In the multiple tube embodiment of FIG. 2, a plurality of sheaths 11 are secured to each other and to the inner wall of the shell by a second tube sheet **16*a*. This tube sheet may be of the same material as the sheaths as described above and the edges of the tube sheet secured between flanges 33 and 34. The means for forming the first fluid flow zone in the embodiment of FIG. 2 comprise the end head 30, shell part 31 and second tube sheet 16*a* to form a chamber 22*a* fed by an inlet 13 on one side of shell part 31 and outlet 14 preferably on the other side of this shell part. A conventional tube support plate or preferably a lattice grid 9 is used to provide even spacing of the bayonet sheaths at the distal ends are required by TEMA (Tubular Exchanger Manufacturers Association). Means for forming the second fluid flow zone in the embodiment of FIG. 2, such as chamber 23*a*, comprise first tube sheet 20*a*, second tube sheet 16*a* and shell part 32 and the areas between each sheath 11 and the bayonet tube 12 concentrically positioned within each sheath with an inlet 15 and an outlet 17 through the shell part 32**.

In the operation of the multiple tube embodiment, the bayonet tubes 12 extending into each sheath pass through the first tube sheet **20*a*. However, rather than having individual connections to a vacuum source, means are included for applying a vacuum source to the outer portion of the plurality of vacuum tubes. As embodied herein this means, as illustrated, includes a vacuum chamber 24 formed by the first tube sheet 20*a*, end head 35, and the portion of shell 32 between the tube sheet and the end head, the chamber having an outlet 25 adaptable for fluid communication with a vacuum source. In this arrangement the vacuum chamber 24 provides a vacuum to the multiple bayonet tubes, each of which passes through the first tube sheet 20*a*** and opens into the vacuum chamber.

FIG. 3 depicts an application of the bayonet tube heat exchanger of FIG. 2 in a vapor recompression evaporator designed for high vacuum operation. This arrangement prevents the formation of scale which is precipitated at atmospheric boiling temperatures and is also useful in preventing the breakdown of heat sensitive chemicals. In this application, the bayonet tube heat exchanger 40 is fed from feed tank 41 through fluid line 42 and inlet 13 into the heat exchanger. (The same reference numerals as used in FIGS. 1 and 2 are used in FIG. 3 where appropriate.)

After flowing through the first fluid flow zone, i.e., chamber **22*a*, surrounding the sheaths 11, the fluid feed exits the heat exchanger 40 in a heated condition via outlets 14 and is conducted by wet vapor uptakes 43 into vapor separator 44. The vapor separator has a series of mesh demistors 45 to entrain liquid droplets which drain to the bottom of the separator 44 and are returned to the feed tank 41 via fluid communication line 46 and pump 47 or taken off as concentrate via fluid communication line 48. The vapor separator is connected by outlet 49 at its upper end to suction vapor delivery line 50 and then to a vapor compressor 51. This vapor compressor 51 pressurizes the vapor and the pressurized vapor, exiting the compressor at its lower end, is delivered to inlet 15 of the heat exchanger 40 via pipe 52. The pressurized vapor flows into the second fluid flow zone i.e., chamber 23a of the embodiment of the heat exchanger, as depicted in FIG. 2. The flow rate of vapor is from about 60–100 ft/sec, as measured at the area of the combined annuli. The vapor condenses in sheaths 11 as heat is transferred through the sheath walls to the cooler feed fluid flowing through chamber 22a. The vapor sweeps non-condensible gases (e.g., air) to the distal end of the sheaths 11 where the bayonet tubes 12, connected via vacuum chamber 24 and outlet 25 to a vacuum line, continuously siphon the non-condensible gases off. As the vapor condenses in sheaths 11, the condensate drains individually from each sheath by the pitch of the sheaths toward the first and second tube sheets 20a, 16a**. Thus, the condensate does not drop down and build up on the lower tube bands to form films of condensate which would blanket the tubes and decrease the heat transfer efficiency.

The condensate drains from the heat exchanger through outlet 17 and passes through drain line 18 which joins the vacuum line exiting from the vacuum chamber 24 at a "T" junction 21. The condensate is then pumped to the distillate tank 53 through fluid line 54 running from the eductor 19 to the distillate tank.

The vapor compression evaporator, as described above, can operate under low temperature and high vacuum conditions. This permits the use of CPVC for piping, evaporator and condensor shells. In addition to reducing construction costs, CPVC is immune to the corrosive effects of salt water and other mediums such as chromic acid solutions formed in electroplating wastes.

Another embodiment of the invention, as depicted FIG. 4, has a thick walled insulating bayonet tube within a thin walled sheath. This embodiment permits the transfer of heat from boiling fluids to circulating hot water or from condensing steam to circulating cooling water with high efficiency. The bayonet tube heat exchanger of FIG. 4 has an outer shell 61 with an elongated center section A, a tubular sheath 65 within the shell and a bayonet tube 66 within the sheath. Shell 60 is substantially horizontal and as depicted, is of tubular shape. The shell has a distal end 60 which may be closed by an end head as described above in relation to FIG. 2 or by a permanently closed end portion as shown in FIG. 4. The shell is sealed at its inner end by first tube sheet 68. Sheath 65 has a closed distal end adjacent, but spaced from, the closed distal end 61 of shell 60 and an open end facing first tube sheet 68. In accordance with the invention, means are provided for forming a first fluid flow zone within the shell surrounding the sheath. Such means, as embodied herein, include a second tube sheet 78 joining the outer surface of sheath 65 to the inner surface of shell 60 to form a fluid chamber 64 with at least one inlet 62 through the shell and at least one outlet 63 through the shell, both being between second tube sheet 78 and the distal end of the shell. Second tube sheet 78 forms a fluid tight seal at the inner end of chamber 64 such that fluid entering inlet 62 flows around sheath 65 and exits through outlet 63.

The bayonet tube 66 is positioned concentrically within the sheath 64. The bayonet tube 66 pierces the tube sheet 68 and an inner portion of the bayonet tube extends substantially the entire length of the sheath 65, terminating in an open end spaced from the closed distal end of the sheath. The bayonet tube 66 has an outer portion which extends through first tube sheet 68. In the single tube embodiment shown in FIG. 4, the bayonet tube is threaded into the interior portion of a double tapped bushing 67 which extends through tube sheet 68 and which is suitable for fluid tight connection to a fluid source at its exterior portion.

In accordance with the invention, means are also provided for forming a second fluid flow zone within the sheath 65. Such means, as embodied herein, include second tube sheet 78, first tube sheet 68 and a portion of the outer shell 60 between the first and second tube sheets, as well as the area between the sheath 65 and the bayonet tube 66. These elements define a fluid chamber 71 such that fluid entering through bayonet tube 66 flows along the length of the bayonet tube to the distal end of sheath 65 and flows back through the annulus between the bayonet tube and the sheath and exits at outlet 72 located in shell 60 between second tube sheath 78 and first tube sheet 68.

In order to minimize reheat of the fluid in the second fluid flow zone, the bayonet tube in this embodiment is constructed of an insulating material such as plastic. Both PVC and CPVC have been found to be suitable materials due to their low cost and the case with which they may be worked.

The sheath 65 and second tube sheet 78 may be made of light gauge titanium or other corrosion resistant metal as described in relation to FIGS. 1 and 2.

In order to position the bayonet 66 within the sheath 65, in the embodiment of the invention of FIG. 4, means are provided such that a relatively uniform annular passage surrounds the bayonet. It is preferred to affix metal wires or pins 90 extending radially from the bayonet tube at equal distance spacings (about 120° apart) around the circumference of the bayonet tube. These pins 90 extend from at least the outer surface of the bayonet tube for a distance as necessary to contact the inner surface of the sheath 65. Pins 90 may be spaced at one or more locations along bayonet tube 65 depending upon the length of the bayonet tube.

In order to reduce entrance drag at the end of the bayonet tube 66 where the fluid flows from the bayonet tubes into the small annular passage between the bayonet tube 66 and the sheath 65, it is preferred to bevel the outer surface of the end of the bayonet tube as shown in FIG. 4.

The plastic bayonet tube of the invention effectively prevents reheating by its insulating quality. The optimum parameters found for this embodiment of the invention uses a one-inch OD (outer diameter) tube of 0.035 wall thickness for the sheath and a ½ inch ips (iron pipe size) (0.84 inch OD) Schedule 80 (0.147 inch) PVC or CPVC tube for the bayonet tube. The preferred inside cross-sectional area of the sheath is 0.679 square inches and the outside cross-sectional area of the bayonet is 0.554 square inches leaving an annular passage surrounding the bayonet of 0.125 square inches in cross-section of about 18 percent of the total area inside of the sheath. A flow rate through each such bayonet tube of two gallons of liquid per minute provides a velocity of 5.1 feet per second through the annular passage surrounding the bayonet. This small annular passage and the relatively high flow velocity creates a high turbulence in the fluid in the annular passage which promotes overall heat transfer rates of 600–800 BTU/cf/°F. at the high vacums at which these heat exchanges are operated. The sheath preferably may range in OD from 0.75" to 1.5" and the bayonet tube from 0.5' to 1.25." The wall thicknesses of the sheath and the bayonet tube can be determined by the intended application but it is preferred that an annular passage with an area of about 18 percent of the total area within the sheath be maintained for the most effective heat transfer rates.

In a multiple tube heat exchanger as shown in FIG. 5, the plastic bayonet tubes 66 may be adhered to plastic tube sheet 69 while a metal tube sheet 78 is used to seal the sheath tubes 65 to each other and to the outer shell. In this embodiment, the tube sheet 78 is sealed between flanges 75 and 76 of outer shell sections 73 and 74 respectively. An inlet fluid plenum 70 is formed by a portion of outer shell section 74 between tube sheet 69 and an end head 77. Fluid enters the plenum 70 through inlet 79 positioned in the wall of shell section 74 between tube sheet 69 and end head 77. A similar inlet plenum is unnecessary in the single tube embodiment of FIG. 4 since the bayonet tube 66 extends into a bushing 67 through tube sheet 68 providing a direct connection to a fluid supply line.

Bayonet tubes 66 can be enhanced by being spirally grooved with integral helical ridges on their surfaces as designated by tube **66*a* of FIG. 5. This enhancing imparts high turbulance in the fluid in the annular passage between sheath 65 and tube 66*a*** thus promoting high heat transfer rates. Such a tube is commercially available from Wolverine Division of UOP, Inc. under the trademarks KORODENSE® and TURBO-CHIL®.

The embodiment of FIG. 5 of a bayonet tube heat exchanger of the invention in addition to providing high heat transfer rates, cost effectiveness in construction and operation and compact arrangement performs functions which would be impossible or quite expensive in standard heat exchanger constructions. For example, a "U" tube design would not be able to use the light gauge corrosion resistant metals found in this invention since such materials are almost impossible to bend to a short radius. Further, smaller tube diameters have to be used in conventional construction to provide necessary tube velocities for good heat transfer rates. The use of 0.5" to 1.25" OD bayonet tubes and 0.75" to 1.5" OD sheaths in this invention, in addition to being economical tube sizes, also provides optimum water flow velocities without use of much smaller tubes and attendant increase in the number of drill holes and construction costs.

A further preferred embodiment of a multiple bayonet tube heat exchanger is depicted in FIG. 6. This embodiment has a two-pass water box arrangement wherein one or more bayonet tubes 83 and one or more bayonet tubes 87 rather than connecting to a single plenum 71 as in FIG. 5, connect to two plenums 80 and 81. Thus, the second fluid flow zone has fluid entering plenum 80 through inlet 82 through a tube sheet closure 91 from which it enters at least one bayonet tube 83 which is in fluid communication with plenum 80. This fluid travels the length of the bayonet tube 83 and returns through annular passage 84 between the bayonet tube and its sheath 89 into chamber 85. Fluid entering chamber 85, which is formed by tube sheet **78*a*, tube sheet 69*a* shell section 74*a*, then travels into annular passage 86 surrounding bayonet tube 87 and exits down at least one bayonet tube 87 which is in fluid communication with plenum 81 and exits through outlet 88**. This arrangement increases the water velocities through the heat exchanger. Such velocities may be further increased by adding additional passes.

FIG. 7 provides an illustration of one application of the embodiment of the bayonet tube heat exchanger described in relation to FIG. 4. The heat exchanger can be coupled with a domestic hot water heater to produce low cost potable water from contaminated well water. Water from the hot water tank 100, i.e., a first fluid, is supplied via fluid line 114 to the inlet **62*a* feeding the first fluid flow zone of bayonet tube heat exchanger 101 to be further heated. Additional water from tank 100 is supplied via fluid line 115 and pump 116 to inlet 67*b* feeding the second fluid flow zone of bayonet tube heat exchanger 102. A second fluid introduced through inlet 67*a* feeding the second fluid flow zone of heat exchanger 101 is heated by an auxiliary electric heater 104 in heater loop 103 serviced by pump 117. The heated fluid entering inlet 67*a* from loop 103 exits the heat exchanger 101 at outlet 72*a*** and recirculates through the heater loop after giving up its heat to the water in the first fluid flow zone.

The heated water and water vapor from the first fluid flow zone exits from outlet 63 and flows through pipe 105 to vapor separator 106. The liquid water in the separator 106, which contains concentrated pollutants, drains through outlet 107 to drain line 108 and is pumped away by pump 118. The vapor at about 165° F. from the upper end of separator 106 is introduced via fluid line 119 into the inlet **62*b* feeding the first fluid flow zone of bayonet tube heat exchanger 102. The water entering heat exchanger 102 from tank 100 through inlet 67*b* feeding the second fluid flow zone of exchanger 102 causes the vapor in the first fluid flow zone to condense. Distilled water is taken off through outlet 109 which communicates with the first fluid flow zone. The distillate is pumped via fluid line 110 connected to a wet vacuum pump 111**.

The water exiting heat exchanger 102 through outlet **72*b* is at a temperature of 120°–140° F. and returns via fluid line 112 to a valve 113 which directs it through the household hot water system or returns it to the hot water tank 100. With this system, using single tube bayonet tube heat exchangers of the type depicted in FIG. 4**, for every twelve gallons of water raised 80° F., one gallon of distilled water can be produced for less than ⅛ of a KW for pumping costs. This application can also be used for a small electroplating set up to concentrate and recover plating wastes. The ganged pumping system used is described in U.S. Pat. No. 3,358,609.

Figure 8:
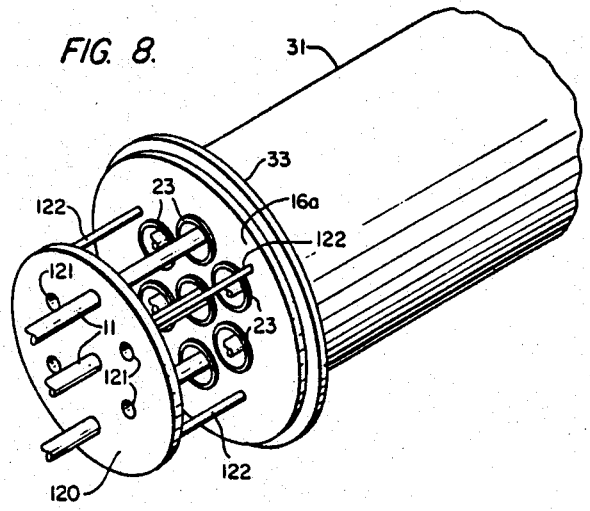
FIG. 8 is an exploded view of a guidance plate for a multiple bayonet tube heat exchanger with a set of bayonet tubes partially inserted into the plate.

In order to assemble the multiple tube bayonet tube heat exchangers, as depicted in FIG. 2, especially when there are dozens or hundreds of bayonet tubes involved, a guidance means is provided to permit the bayonet tubes to be aligned with their corresponding sheath tubes. As depicted in FIG. 8, a circular plate 120 is provided with holes 121. The number of holes at least equals the number of bayonet tubes used in the heat exchanger in which such guidance plate is employed. The plate may be of plastic or metal depending upon the operating temperature range of the heat exchanger in which it is used. The holes 121 are positioned to correspond with the openings of the sheaths in the second tube sheet **16*a*. As depicted in FIG. 2, the plate 120 is dimensioned to fit within the outer shell of the heat exchanger and is held a distance away from tube sheet 16*a* by positioning rods 122. The holes in plate 120** are slightly larger than the diameter of the bayonets in order to enable the bayonets to slide freely through the positioning holes and into the sheath tubes.

In operation, the free ends of the bayonet tubes are inserted into holes 121 in plate 120 and the plate is aligned with the sheath tubes 11. Then, by pushing the bayonet first tube sheet 20*a*, the bayonet tubes slide through the plate 120 and along the length of sheath tubes 11 until the positioning rods 122 contact the sheath tube sheet 16*a*. This plate enables the proper positioning of the bayonets upon insertion and maintains them in proper spaced relationship upon removal of the bayonet tubes from the heat exchanger.

Other applications and modifications of this invention will be obvious to one skilled in the art of heat exchangers. Such applications may include the use of the bayonet tube heat exchanger with a climbing film evaporator in conjunction with a freon heat pump with secondary heat transfer loops using distilled water to prevent transfer of radioactivity from the concentration of radioactive wastes. Reference to Williamson U.S. Pat. Nos. 3,248,305; 3,339,118; 3,420,747 will furnish further details as to applications particularly as they would apply of a freon pump.

The freon condenser of the heat pump can employ the bayonet tube heat exchanger using enhanced tubing for the sheath. Finned or twisted tubes 65*a*, 65*b* as illustrated in FIGS. 4A and 4B respectively, similar to those described in U.S. Pat. No. 3,533,267 can be used to condense the freon vapors on the outside of the sheath and transfer heat to distilled water, or other liquid to be heated, in the annulus between the sheath and the insulating bayonet. Such sheaths are commerically available under the KORODENSE® and TURBO-CHIL® trademark.

The bayonet tube heat exchanger may be used with a long tube flash evaporator of the type depicted in Williamson U.S. Pat. No. 3,186,924 and would be particularly advantageous. The bayonet tube heat exchanger could replace the condenser portion identified as 22 in U.S. Pat. No. 3,186,924 and would reduce the length of the heat recovery condenser in half and eliminate any problem with expansion stresses. For example, a long tube flash evaporator requiring ½" OD tubes in order to acquire optimum tube velocity could use 1" OD bayonet sheaths and insulating bayonet tubes providing the small annuli area which would require half the length heat transfer tube in order to acquire the same square feet of heat transfer surfaces with the same tube velocities. The number of tube holes to be drilled would be greatly reduced and save in tubing and fabrication costs. The division plates 45 in the U.S. Pat. No. 3,186,924 can be part of the new removable bayonet tube bundle and would eliminate the need for flanging sections 41.

It is intended that modifications and variations of the above embodiments can be made within the scope of this invention as defined by the appended claims and their equivalents.

I claim:

1. A method for operating a bayonet tube heat exchanger comprising:

(a) forming a first fluid flow zone between the inner surface of a shell having a closed end and the outer surface of a tubular thin gauge sheath having a closed end, the closed end of the sheath being spaced from the closed end of the shell;

(b) forming a second fluid flow zone between the inner surface of the sheath and the outer surface of a bayonet tube concentrically inserted into said sheath, the inner end of said bayonet tube being open and spaced from the closed end of said sheath, and the outer end of said bayonet tube extending outside said second fluid flow zone;

(c) causing a first fluid to flow through said first fluid flow zone;

(d) causing a second fluid to flow through said second fluid flow zone wherein said second fluid is condensed in heat exchange relation with said first fluid flow zone, said second fluid flow zone including the annulus formed between said bayonet tube and the inner surface of said sheath;

(e) directing said second fluid into said annulus in the direction of said open end of said bayonet tube;

applying a vacuum source to the outer end of said bayonet tube for directing fluid flow in said bayonet tube in the direction opposite that of said second fluid flow in said annulus for removing condensate and non-condensible gases entrained in said second fluid from said annulus to said vacuum source; and (g) removing condensate from said second fluid flow zone.

2. The method of claim 1 further comprising applying a vapor compressor to said first fluid flow zone thereby compressing said vapor and passing said compressed vapor to said second fluid flow zone wherein said vapor is condensed.

3. The method of claim 1, wherein the cross-sectional area of said bayonet tube is approximately 1/16 of the cross-sectional area of its concentric sheath.

4. A bayonet tube heat exchanger comprising:

(a) a substantially horizontal outer shell having an elongated center section, an inner end having a first tube sheet closure and a closed distal end;

(b) at least one thin gauge tubular sheath having a closed end adjacent but spaced from said closed distal end of said shell and an open end facing said first tube sheet closure of said shell;

(c) means for forming a first fluid flow zone between the outer surface of said sheath and said shell;

(d) a bayonet tube concentrically positioned in at least one of said sheaths, said bayonet tube piercing said first tube sheet closure, and having an outer portion extending at least through said first tube sheet closure and an inner portion terminating in an open end spaced from said closed end of said sheath;

(e) means for forming a second fluid flow zone wherein a second fluid is condensed in heat exchange relation with said first fluid flow zone, said second fluid flow zone including the annulus formed between said bayonet tube and the inner surface of said sheath;

(f) means for directing said second fluid into said annulus in the direction of said open end of said bayonet tube;

(g) means for removing condensate from said second fluid flow zone; and (h) means for applying a vacuum source to the outer end of said bayonet tube for directing fluid flow in said bayonet tube in the direction opposite that of said second fluid flow in said annulus whereby condensate and non-condensible gases entrained in said second fluid are removed from said annulus to said vacuum source.

5. The bayonet tube heat exchanger according to claim 4 wherein said means for applying said vacuum source is a pipe for fluid communication to said vacuum source.

6. The bayonet tube heat exchanger according to claim 4, wherein said means for applying a vacuum source to said outer end of said bayonet tube comprises a vacuum chamber adjacent said first tube sheet closure and in fluid communication with a vacuum source, said outer end of said bayonet tube opening into said vacuum chamber.

7. The bayonet tube heat exchanger of claim 6, wherein the closed distal end of said shell includes a sight window.

8. The bayonet tube heat exchanger of claim 6, wherein the side of said vacuum chamber opposite the first tube sheet includes a sight window.

9. The bayonet tube heat exchanger according to claim 4, including a plurality of tubular sheaths each with its concentric bayonet tube and wherein said means for forming said first fluid flow zone includes a second tube sheet closure joining the outer surfaces of the open ends of said sheaths and the inner surface of said shell, and wherein said means for forming said second fluid flow zone includes a plenum between said second tube sheet closure, said first tube sheet closure and said shell.

10. The bayonet tube heat exchanger of either of claims 4 or 9, having a circular plate for positioning bayonet tubes in sheaths, said plate having a diameter substantially equal to the inner diameter of said shell and having a plurality of holes, said holes corresponding to the sheaths in number and located in said plate in corresponding relationship to said sheaths, said holes having a diameter slightly larger than and engageable for sliding relationship with said bayonet tubes when the open ends of said bayonet tubes are inserted in said holes, and means for positioning said plate in the heat exchanger at a fixed distance from said first tube sheet closure.

11. The plate of claim 10, wherein the means for positioning the plate a fixed distance from the first tube sheet includes a plurality of spacer rods fixed at one end to the plate.

12. The bayonet tube heat exchanger according to claim 9, wherein said means for forming said first and second fluid flow zones include at least one inlet and one outlet for each said zone, the inlet and outlet for said second zone opening into said plenum, and wherein said means for removing condensate from said second fluid flow zone includes said outlet for said second fluid flow zone.

13. The bayonet tube heat exchanger according to claim 4, 9 or 12, wherein the cross-sectional area of each bayonet tube is approximately 1/16 the cross-sectional area of its concentric sheath.

14. The bayonet tube heat exchanger according to claim 14, 9 or 12, wherein each tubular sheath is inclined downwardly toward said first tube sheet closure of said shell.

15. The bayonet tube heat exchanger according to claim 9, wherein said means for forming a first fluid flow zone includes at least one inlet and one outlet through said shell, and wherein said means for forming a second fluid flow zone includes an inlet through said outer portion of at least one of said bayonet tubes and an outlet through at least one other of said bayonet tubes.

16. The bayonet tube heat exchanger according to claim 9 wherein said means for forming a first fluid flow zone includes at least one inlet and one outlet through said shell, and wherein said means for forming a second fluid flow zone includes an inlet through said outer portion of each said bayonet tube and at least one outlet through said shell.

17. The bayonet tube heat exchanger of claim 16 including an inlet feed chamber into which said outer portions of said bayonet tubes open.

18. The bayonet tube heat exchanger according to claim 4 wherein said means for forming a first fluid flow zone includes at least one inlet and one outlet through said shell, and wherein said means for forming a second fluid flow zone includes an inlet through said outer portion of each said bayonet tube and at least one outlet through said shell.

19. The bayonet tube heat exchanger according to any one of claims 4, 9, 18 and 16, wherein each of said sheaths is formed of corrosion resistant metal.

20. The bayonet tube heat exchanger of claim 19 wherein said corrosion resistant metal is titanium.

21. The bayonet tube heat exchanger of claim 18 including an inlet feed chamber into which said outer portions of said bayonet tubes open.

22. The bayonet tube heat exchanger according to any one of claims 21, 17 and 15, wherein said open end of said bayonet tube is bevelled around its exterior circumference.

23. The bayonet tube heat exchanger of any one of claims 18, 16, 21, 17 and 15, wherein the bayonet tubes and the sheaths are dimensioned to provide an annular passage between the sheath and the bayonet tube having a cross-sectional area which is less than twenty-five (25%) percent of the inner cross-sectional area of the sheath.

24. The bayonet tube heat exchanger according to claim 18, wherein each of said bayonet tubes is formed of insulating material for preventing reheating of fluid flowing in said second fluid flow zone.

25. The bayonet tube heat exchanger of claim 24, wherein the bayonet tube has positioning means for maintaining said tube uniformly cncentric within said sheath.

26. The bayonet tube heat exchanger of claim 25, wherein said positioning means includes three spacers each projecting radially from said bayonet tube at 120° apart from each other around the circumference of said bayonet tube.

27. The bayonet tube heat exchanger according to claim 24, wherein said insulating material is plastic.

28. The bayonet tube heat exchanger according to claim 27, wherein said plastic bayonet tube is spirally grooved on its external surface whereby turbulent flow is imparted to said second fluid.

29. The bayonet tube heat exchanger according to claim 27, wherein each of said sheaths are provided with means for imparting turbulent flow to said second fluid.

30. The bayonet tube heat exchanger according to claim 29, wherein said means for imparting turbulent flow to said second fluid comprises spirally grooved external surfaces of said sheaths.

31. A freon heat pump comprising:

(a) a freon compressor; and (b) a freon chiller comprising:

i. a substantially horizontal outer shell having an elongated center section, and inner end having a first tube sheet closure and a closed distal end;

ii. at least one externally finned tubular sheath having a closed end adjacent but spaced from said closed distal end of said shell and an open end facing said first tube sheet closure of said shell;

iii. means for forming a first fluid flow zone between the outer surfaces of said finned sheath and said shell;

iv. an insulating plastic bayonet tube concentrically positioned in at least one of said sheaths, said bayonet tube piercing said first tube sheet closure and an inner portion terminating in an open end spaced from the closed end of said sheath; and v. means for forming a second fluid flow zone wherein a second fluid is condensed in heat exchange relation with said first fluid flow zone, said second fluid zone including the annulus formed between said bayonet tube and the inner end of said sheath;

vi. means for directing said second fluid into said annulus in the direction of said open end of said bayonet tube;

vii. means for removing condensate from said second fluid flow zone; and viii. means for applying a vacuum source to the outer end of said bayonet tube for directing fluid flow in said bayonet tube in the direction opposite that of said second fluid flow and said annulus whereby condensate and non-condensible gases entrained in said second fluid are removed from said annulus to said vacuum source.

* * * * *